US010684036B2

(12) United States Patent
Oishi

(10) Patent No.: US 10,684,036 B2
(45) Date of Patent: Jun. 16, 2020

(54) INDOOR UNIT FOR AIR-CONDITIONING APPARATUS

(71) Applicant: Mitsubishi Electric Corporation, Tokyo (JP)

(72) Inventor: Masayuki Oishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/096,151

(22) PCT Filed: Jul. 22, 2016

(86) PCT No.: PCT/JP2016/071505
§ 371 (c)(1),
(2) Date: Oct. 24, 2018

(87) PCT Pub. No.: WO2018/016065
PCT Pub. Date: Jan. 25, 2018

(65) Prior Publication Data

US 2019/0137132 A1 May 9, 2019

(51) Int. Cl.

| | |
|---|---|
| ***F24F 11/52*** | (2018.01) |
| ***F24F 13/20*** | (2006.01) |
| *F21Y 115/10* | (2016.01) |
| *F21V 3/02* | (2006.01) |

(52) U.S. Cl.
CPC ..... *F24F 11/52* (2018.01); *F24F 13/20* (2013.01); *F21V 3/02* (2013.01); *F21Y 2115/10* (2016.08)

(58) Field of Classification Search
CPC ..... F24F 11/52; F21V 3/02
See application file for complete search history.

(56) References Cited

FOREIGN PATENT DOCUMENTS

| | | | |
|---|---|---|---|
| CN | 1755751 | A | 4/2006 |
| EP | 1 326 055 | A1 | 7/2003 |
| EP | 2 045 538 | A2 | 4/2009 |
| EP | 2 719 964 | A2 | 4/2014 |
| JP | 2002-310491 | A | 10/2002 |
| JP | 2006-091602 | A | 4/2006 |
| JP | 2009-103427 | A | 5/2009 |
| JP | 2010-190535 | A | 9/2010 |
| JP | 2010-256597 | A | 11/2010 |

(Continued)

OTHER PUBLICATIONS

International Search Report of the International Searching Authority dated Aug. 23, 2016 for the corresponding international application No. PCT/JP2016/071505 (and English translation).

(Continued)

*Primary Examiner* — Joseph L Williams
(74) *Attorney, Agent, or Firm* — Posz Law Group, PLC

(57) ABSTRACT

An indoor unit for an air-conditioning apparatus: a display panel arranged on a front surface side; a display device, which includes a light-emitting device that is allowed to control turning on and turning off, and is arranged so as to be opposed to a back surface of the display panel; and an icon, which is formed on a surface of the display panel, and is configured to notify predetermined information. The icon includes a light blocking layer that is printed with ink that blocks transmission of light, and is visually recognized by radiating light emitted from the light-emitting device from an inner side of the indoor unit.

4 Claims, 4 Drawing Sheets

(56) References Cited

FOREIGN PATENT DOCUMENTS

| | | | |
|---|---|---|---|
| KR | 2009-0098516 | A | 9/2009 |
| KR | 2010-0055204 | A | 5/2010 |

OTHER PUBLICATIONS

Extended European Search Report dated Jul. 4, 2019 issued in corresponding European patent application No. 16909540.3.
Office Action dated Dec. 3, 2019 issued in corresponding JP patent application No. 2018-528177 (and English translation).
Office Action dated Apr. 3, 2020 issued in corresponding CN patent application No. 201680087461.4 (and English translation).

INDOOR UNIT FOR AIR-CONDITIONING APPARATUS

CROSS REFERENCE TO RELATED APPLICATION

This application is a U.S. national stage application of PCT/JP2016/071505 filed on Jul. 22, 2016, the disclosure of which is incorporated herein by reference.

TECHNICAL FIELD

The present invention relates to a display portion of an indoor unit for an air-conditioning apparatus.

BACKGROUND ART

Hitherto, a display portion is provided on a front panel of an indoor unit for an air-conditioning apparatus. The front panel is formed by molding a translucent resin or a transparent resin, and coating is applied to a back surface thereof. Patent Literature 1 describes a configuration including a light-emitting device mounted on a display board as a display portion, a display board fixture configured to hold the display board, and a display window formed on the display board fixture. The display window is formed in a shape that is desired to be expressed when the light-emitting device is turned on. In a case where the display window is closely fixed to the back surface of the front panel, when the light-emitting device is turned on, light emitted from the light-emitting device passes through the display window, and further passes through the front panel. Thus, light in a shape of the display window is seen as being emitted from the outer side of the indoor unit, which can be visually recognized by a user. Further, Patent Literature 1 also describes a configuration in which a simple shape is employed for the shape of the display window, and a display sheet having a shape formed therein, which is desired to be expressed is bonded to a front side of the display window.

CITATION LIST

Patent Literature

Patent Literature 1: Japanese Unexamined Patent Application Publication No. 2009-103427

SUMMARY OF INVENTION

Technical Problem

However, in any of the above-mentioned configurations, in order to vividly display the shape desired to be expressed when the light-emitting device is turned on, it is required that the display window be closely fixed to the back surface of the front panel onto which coating is applied. Therefore, in the indoor unit in Patent Literature 1, the display board fixture is urged against the front panel side by a coil spring. Further, when an urging force of the coil spring is insufficient, or an arrangement position of the display board fixture is improper, there is a risk that a gap is formed between the display window and the back surface of the front panel so that the shape desired to be expressed is blurred.

The present invention has been made to solve the problem described above, and an object thereof is to improve the visibility of a display portion of an indoor unit.

Solution to Problem

According to one embodiment of the present invention, there is provided an indoor unit for an air-conditioning apparatus, including: a display panel arranged on a front surface side of the indoor unit; a display device, which includes a light-emitting device that is allowed to control turning on and off, and is arranged so as to face a back surface of the display panel; and an icon, which is formed on a surface of the display panel, and is configured to notify predetermined information, wherein the icon includes a light blocking layer that is printed on the surface of the display panel with ink that blocks transmission of light, and is visually recognized by radiating light emitted from the light-emitting device from an inner side of the indoor unit.

Advantageous Effects of Invention

In an indoor unit for an air-conditioning apparatus according to one embodiment of the present invention, the icon is formed on the surface of the display panel. Consequently, even when a gap is formed between the display device and the display panel, an outline of the icon is not blurred, and the visibility is enhanced. Further, a component for preventing formation of the gap between the display device and the display panel is not required, thereby being capable of suppressing an increase in the number of components.

DESCRIPTION OF EMBODIMENTS

Figure 1:
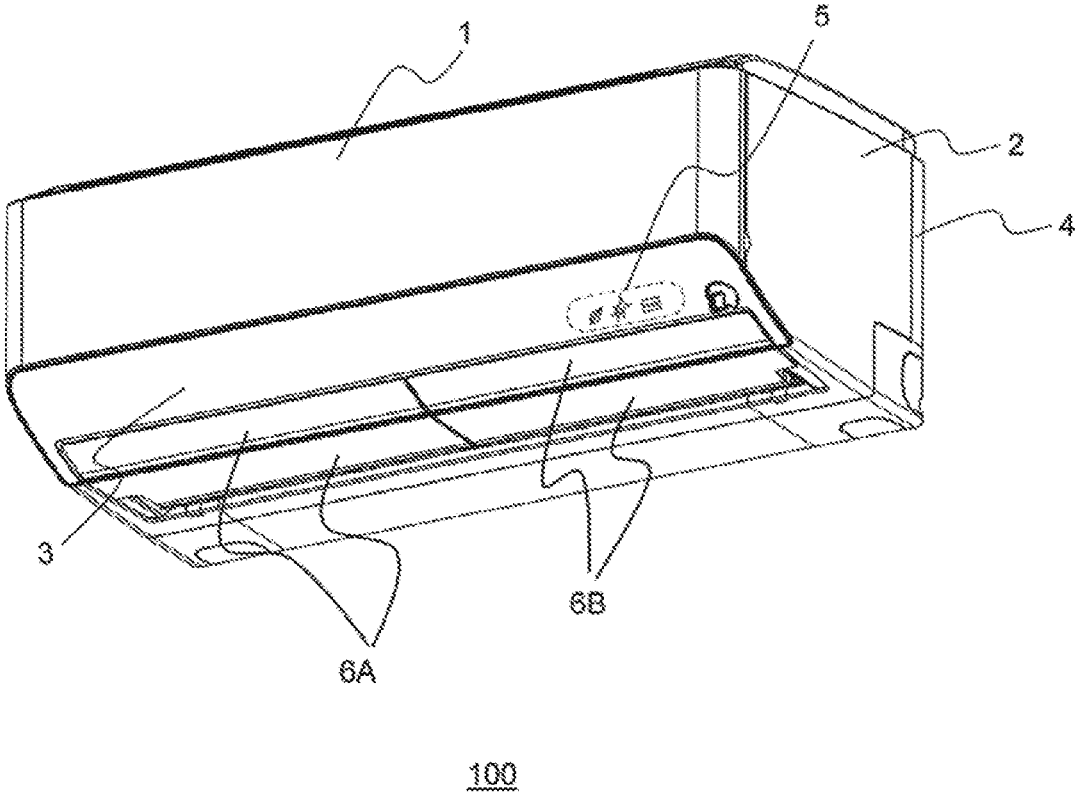
FIG. 1 is a perspective view of an indoor unit for an air-conditioning apparatus according to Embodiment 1 of the present invention.

Hereinafter, embodiments of an indoor unit for an air-conditioning apparatus according to the present invention are described in detail referring to the drawings. It is noted that the present invention is not limited by the embodiments described below. Further, a size of each component may differ from that of an actual device in the drawings given below.

Embodiment 1

FIG. 1 is a perspective view of an indoor unit for an air-conditioning apparatus according to Embodiment 1 of the present invention. An indoor unit 100 for the air-conditioning apparatus includes a design panel 1, side panels 2, a display panel 3, a casing 4, and a pair of vertical airflow-direction flaps 6A and 6B. A heat exchanger, a fan, or other devices (not shown) are mounted in the casing 4. The design panel 1 is arranged on a front surface of the casing 4. The side panels 2 are arranged on side surfaces of the casing 4. The pair of vertical airflow-direction flaps 6A and 6B configured to cover an air outlet is arranged on a bottom surface of the casing 4. Further, the display panel 3 is arranged between the design panel 1 and the pair of vertical airflow-direction flaps 6A and 6B. The design panel 1, the side panels 2, the display panel 3, and the pair of vertical airflow-direction flaps 6A and 6B are each formed by molding a resin. A display portion 5 is formed on a right end portion of the display panel 3. A plurality of icons are arranged in a lateral direction on the display portion 5. Those icons are configured to notify a user in an indoor space of predetermined information. In FIG. 1, three icons are arranged. However, the number of the icons is not limited thereto, and four or more icons may be arranged as necessary.

Figure 2:
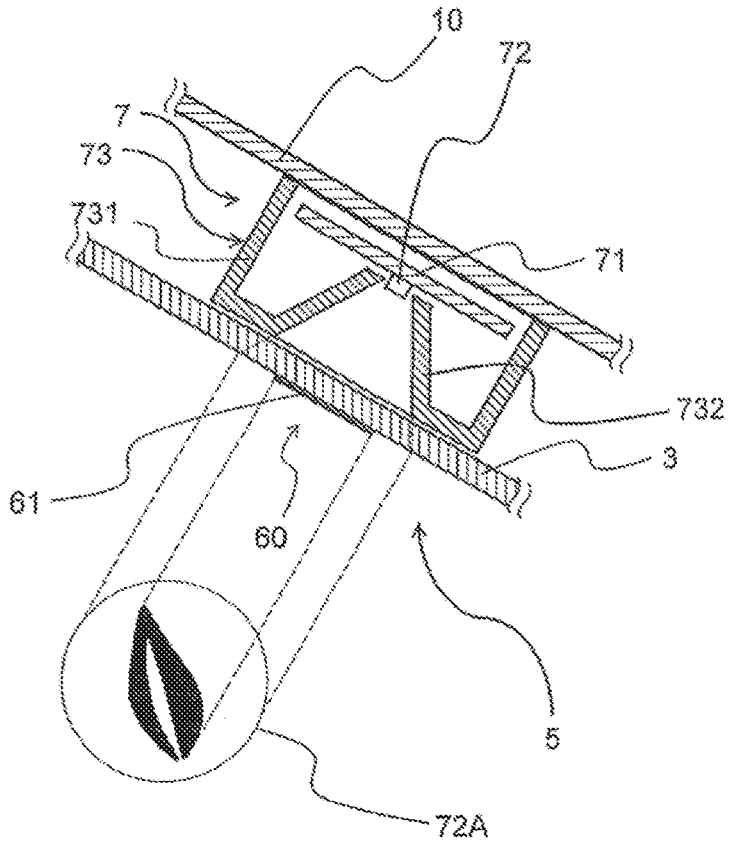
FIG. 2 is a sectional view of a display portion of the indoor unit in Embodiment 1 of the present invention.

FIG. 2 is a sectional view of the display portion of the indoor unit in Embodiment 1 of the present invention. FIG. 2 is a sectional view illustrating the display portion 5, which is cut in a longitudinal direction at a position of the icon at a left end of the display portion 5, when viewed from a right side surface. An icon 60 includes a light blocking layer 61. The light blocking layer 61 is formed through printing with ink that blocks transmission of light on a front surface of the display panel 3, that is, a surface facing the indoor side. The light blocking layer 61 has a shape as illustrated in FIG. 2 in front view.

Figure 3:
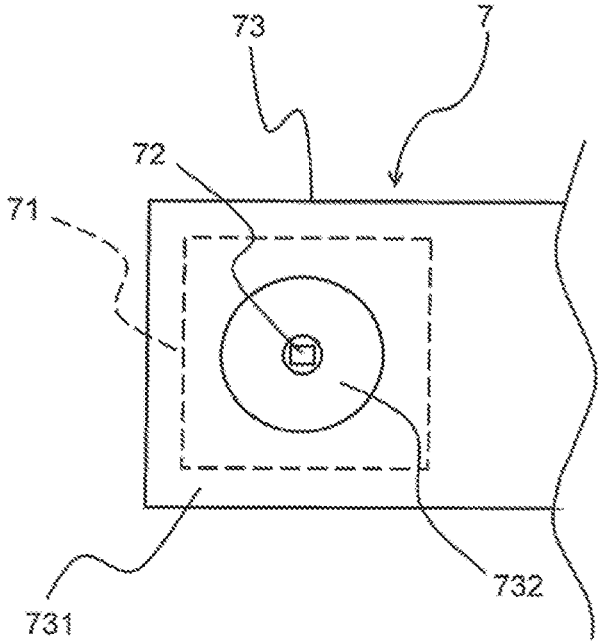
FIG. 3 is a front view of a display device according to Embodiment 1 of the present invention.

FIG. 3 is a front view of a display device in Embodiment 1 of the present invention. As illustrated in FIG. 2 and FIG. 3, the display device 7 includes a display board 71, a light-emitting device 72 mounted on the display board 71, and a display-board holding member 73 configured to hold the display board 71. The display-board holding member 73 includes a fixing portion 731, and a diffusing portion 732. The display-board holding member 73 is fixed to a frame 10 arranged in the indoor unit 100 through the fixing portion 731. The diffusing portion 732 is formed into a tapered shape so that a diameter thereof is gradually reduced toward an inner side of the indoor unit 100. The diffusing portion 732 is opened in a rectangular shape at a bottom surface, and is opened in a circular shape at a position closer to the display panel 3. As the light-emitting device 72, for example, a light emitting diode (LED) is used. The light-emitting device 72 is connected to a controller (not shown) of the indoor unit 100 through a cable (not shown), and turning on and off of the light-emitting device 72 are controlled. The light-emitting device 72 is arranged so as to be positioned in the opening of the bottom surface of the diffusing portion 732 in front view. Light emitted from the light-emitting device 72 is diffused by the diffusing portion 732 to be radiated onto the display panel 3. As illustrated in FIG. 2, the diffusing portion 732 is formed such that an irradiation range 72A, in which the light emitted from the light-emitting device 72 and diffused irradiates the display panel 3, covers the entire icon 60.

As described above, the light blocking layer 61 is formed through printing with ink that blocks transmission of light. Therefore, when the light-emitting device 72 is turned on, and the light blocking layer 61 is irradiated from the inner side of the indoor unit 100, the light is blocked in a region on which the light blocking layer 61 is formed, and the light passes through a portion other than the light blocking layer 61 to be guided to the indoor side. As a result, the icon 60 is emerged as a shadow, and is visually recognized by a user.

In Embodiment 1, the light blocking layer 61 formed on the front surface of the display panel 3 is irradiated so that the icon 60 can be visually recognized by a user. Therefore, even when a gap is formed between the display device 7 and the display panel 3, the icon 60 is not likely to be blurred, and the visibility of the icon display is enhanced. Further, a component for preventing formation of the gap between the display device 7 and the display panel 3 is not required, thereby being capable of suppressing an increase in an increase in the number of components.

Further, the icon 60 is formed through printing with ink that blocks transmission of light, thereby being easily capable of expressing a fine shape. In other words, a display sheet for expressing the fine shape is not required to be provided, thereby being capable of suppressing an increase in the number of components.

Further, in Embodiment 1, the light blocking layer 61 may be formed with ink of a color that is the same as or similar to a color of the display panel 3. By using ink of the color that is the same as or similar to color of the display panel 3, and the icon 60 is assimilated to the display panel 3 when the light-emitting device 72 is turned off. As a result, the designability of the display panel 3 is improved.

The light blocking layer 61 is formed on the surface of the display panel 3, which faces the indoor side. However, the present invention is not limited thereto. The light blocking layer 61 may be formed on a back surface of the display panel 3, that is, a surface facing the inner side of the indoor unit 100.

The display-board holding member 73 of the display device 7 is fixed to the frame 10 on the inner side of the indoor unit 100 through the fixing portion 731. However, the present invention is not limited thereto. The display device 7 may be fixed to the back surface of the display panel 3.

The diffusing portion 732 is opened in a rectangular shape at the bottom surface, and is opened in a circular shape at a position closer to the display panel However, the present invention is not limited thereto. The diffusing portion 732 may be opened in a circular shape at the bottom surface, or opened in a rectangular shape at a position closer to the display panel 3 as long as the light emitted from the light-emitting device 72 is diffused to be guided to the display panel 3.

Further, the diffusing portion 732 is formed into a tapered shape. However, the present invention is not limited thereto. The diffusing portion 732 may be formed into a columnar shape or a quadrangular prism shape. In this case, the sizes of the openings at the bottom surface and at a position closer to the display panel 3 are set so that the light emitted from the light-emitting device 72 is diffused.

In the description above, the icon 60 at the left end of the display portion 5 is described as an example. However, a display device similar to the display device 7 is provided for each of an icon at a center of the display portion 5 and an icon at a left end of the display portion 5.

Embodiment 2

Figure 4:
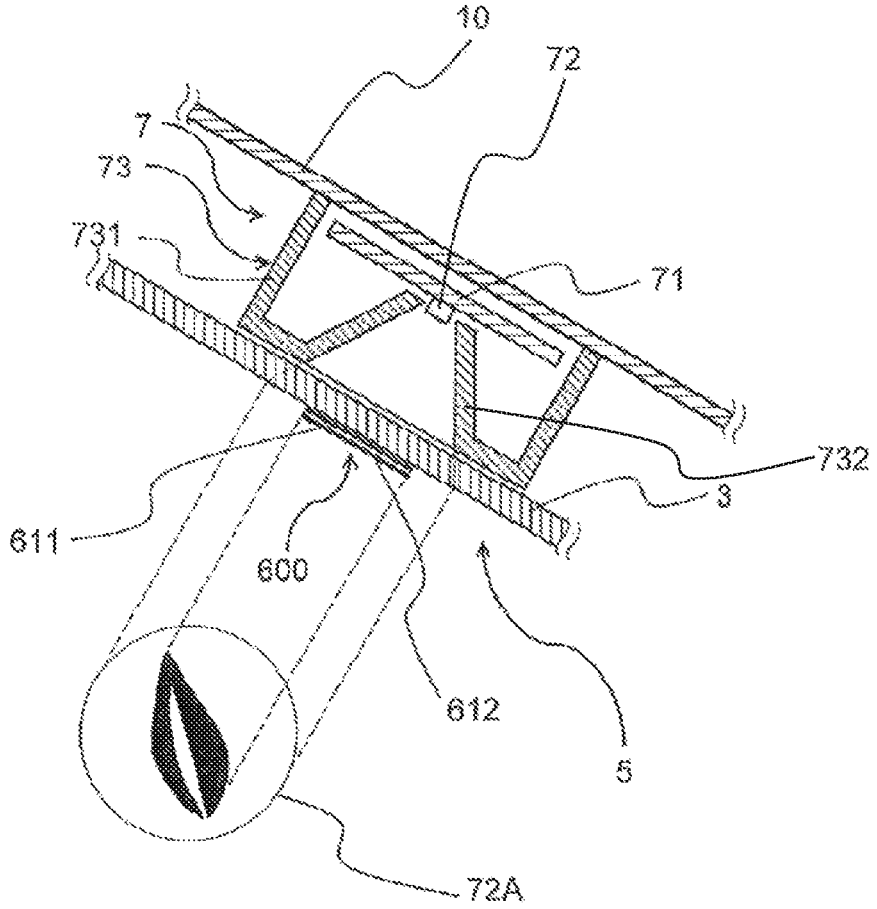
FIG. 4 is a sectional view of a display portion of an indoor unit for an air-conditioning apparatus according to Embodiment 2 of the present invention.

FIG. 4 is a sectional view of a display portion of an indoor unit for an air-conditioning apparatus according to Embodiment 2 of the present invention. In FIG. 4, the same members as in Embodiment 1 are denoted by the same reference symbols as in FIG. 2. In Embodiment 2, an icon 600 includes a light blocking layer 611 and a colored layer 612. As in the case of the light blocking layer 61 in Embodiment 1, the light blocking layer 611 is formed through printing with ink that blocks transmission of light on the front surface of the display panel 3, that is, the surface facing the indoor side. The colored layer 612 is formed through printing with ink that has color that is the same as or similar to color of the display panel 3 so as to be superimposed on the light blocking layer 611. That is, the colored layer 612 is formed on the indoor side with respect to the light blocking layer 611. The light blocking layer 611 and the colored layer 612 have the same shape or size as that of the light blocking layer 611 in front view, and exhibit a shape of the icon 600 as illustrated in FIG. 4.

According to Embodiment 2, the icon 600 is formed by the above-mentioned light blocking layer 611 and the colored layer 612. Therefore, when the light-emitting device 72 is turned on, the icon 600 is emerged to be displayed, and the visibility is enhanced. When the light-emitting device 72 is turned off, the icon 600 is assimilated to the display panel 3, and the designability is improved.

The icon 600 is formed on the front surface of the display panel 3, that is, the surface facing the indoor. However, the present invention is not limited thereto. The colored layer 612 may be formed on the back surface of the display panel 3, that is, the inner side surface of the indoor unit 100. In other words, the colored layer 612 may be formed on the surface facing the inner side of the indoor unit 100, and the light blocking layer 611 may be formed on the colored layer 612.

Embodiment 3

Figure 5:
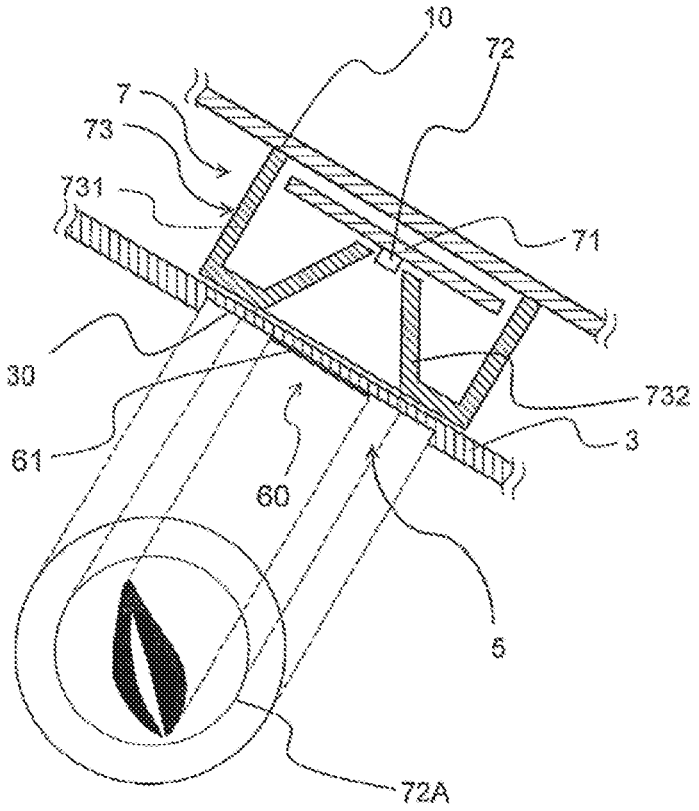
FIG. 5 is a sectional view of a display portion of an indoor unit for an air-conditioning apparatus according to Embodiment 3 of the present invention.
Figure 6:
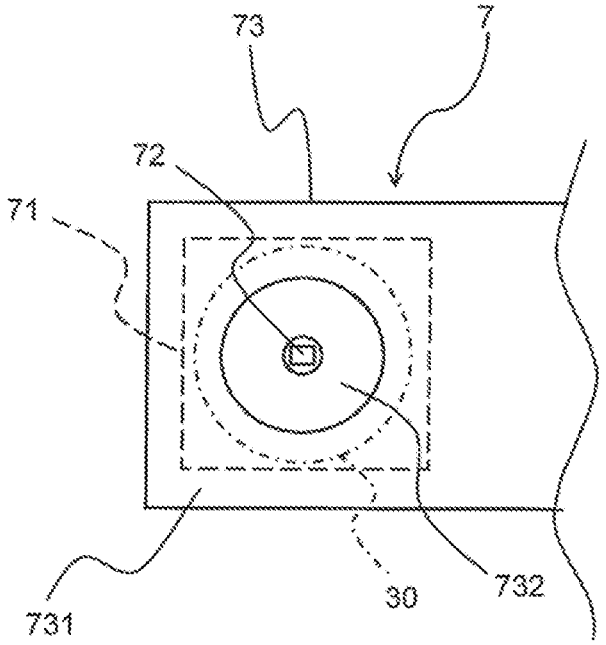
FIG. 6 is a front view of a display device according to Embodiment 3 of the present invention.

FIG. 5 is a sectional view of a display portion of an indoor unit for an air-conditioning apparatus in Embodiment 3 of the present invention. FIG. 6 is a front view of a display device in Embodiment 3 of the present invention. In FIG. 5 and FIG. 6, the same members as in Embodiment 1 are denoted by the same reference symbols as in FIG. 2 and FIG. 3. In Embodiment 3, in the display panel 3, there is formed a thin portion 30 that is smaller in thickness in an optical axis direction of the light-emitting device 72 than other regions. The light blocking layer 61 is formed on a front surface of the thin portion 30 on the indoor side. As illustrated in FIG. 5, the thin portion 30 is formed so that the light, which is emitted from the light-emitting device 72 and is diffused, covers an entire irradiation range 72A on which the display panel 3 is irradiated.

In Embodiment 3, the light blocking layer 61 is formed on the thin portion 30 of the display panel 3. Therefore, even in a case where the display panel 3 is dark-colored, when the light-emitting device 72 is turned on, the light emitted from the light-emitting device 72 is not affected by the color of the display panel 3. Thus, desired color can be displayed.

Also in Embodiment 3, the light blocking layer 61 may be formed on a back surface of the thin portion 30, that is, the surface facing the inner side of the indoor unit 100. Further, the light blocking layer 61 may be formed with ink of color that is the same as or similar to the color that is colored on the display panel 3.

In Embodiments 1 to 3, color of the light emitted from the light-emitting device may be changed in accordance with attribution of the icon. For example, a light-emitting device configured to emit light of cold color may be arranged for an icon for alerting a user, and a light-emitting device configured to emit light of warm color is arranged for an icon for notifying that an energy-saving mode is being executed. Further, an operation switch for the light-emitting device may be provided on a remote controller or other devices, and a controller (not shown) may be capable of changing the color of the light emitted from the light-emitting device in accordance with an operation of the operation switch by a user.

REFERENCE SIGNS LIST

1 design panel 2 side panel 3 display panel 4 casing 5 display portion 6A vertical airflow-direction flap 6B vertical airflow-direction flap 7 display device 10 frame 30 thin portion 60 icon 61 light blocking layer 71 display board 72 light-emitting device 72A irradiation range 73 display-board holding member 100 indoor unit 600 icon 611 light blocking layer 612 colored layer 731 fixing portion 732 diffusing portion

The invention claimed is:

1. An indoor unit for an air-conditioning apparatus, comprising:

a display panel arranged on a front surface side of the indoor unit;

a display device that includes a light-emitting device capable of controlling turning on and off and that is arranged so as to face a back surface of the display panel;

an icon that is formed on a surface of the display panel and that is configured to notify predetermined information, the icon includes a light blocking layer that is printed on a surface of the display panel with ink that blocks transmission of light, and is visually recognized by radiating light emitted from the light-emitting device from an inner side of the indoor unit;

a display board that includes the light emitting device; and a light diffuser that includes a top opening, a bottom opening that exposes the light emitting device, and an inclined sidewall that connects the top opening to the bottom opening and that extends at an oblique angle to the display board.

2. The indoor unit for an air-conditioning apparatus of claim 1, wherein color of the ink of the light blocking layer is the same as or similar to color of the display panel.

3. The indoor unit for an air-conditioning apparatus of claim 1, wherein the icon includes a colored layer formed with the ink of color that is same as or similar to color of the display panel, and wherein the colored layer is formed closer to indoor than the light blocking layer.

4. The indoor unit for an air-conditioning apparatus of claim 1, wherein the display panel includes a thin portion that is smaller in thickness in an optical axis direction of the light-emitting device than other regions, and the icon is formed on a surface of the thin portion.

* * * * *